US011015421B2

(12) United States Patent
Hern et al.

(10) Patent No.: US 11,015,421 B2
(45) Date of Patent: May 25, 2021

(54) MODULAR SIDE POCKET ICD

(71) Applicants: Gregory Hern, Porter, TX (US); Dylan Bulloch, Houston, TX (US); Jonathan Nelson, Accra (GH); Zhi Yong He, Cypress, TX (US); Luis A. Castro, Spring, TX (US)

(72) Inventors: Gregory Hern, Porter, TX (US); Dylan Bulloch, Houston, TX (US); Jonathan Nelson, Accra (GH); Zhi Yong He, Cypress, TX (US); Luis A. Castro, Spring, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/585,352

(22) Filed: Sep. 27, 2019

(65) Prior Publication Data

US 2021/0095549 A1 Apr. 1, 2021

(51) Int. Cl.
*E21B 43/12* (2006.01)
*E21B 47/00* (2012.01)

(52) U.S. Cl.
CPC ..... *E21B 43/12* (2013.01); *E21B 47/00* (2013.01)

(58) Field of Classification Search
CPC ..... E21B 43/12; E21B 43/123; E21B 34/101; E21B 34/105–107; E21B 47/00
See application file for complete search history.

(56) References Cited

U.S. PATENT DOCUMENTS

| | | | | |
|---|---|---|---|---|
| 4,066,128 | A | 1/1978 | Davis et al. | |
| 4,399,871 | A * | 8/1983 | Adkins | E21B 41/02 166/325 |
| 4,711,304 | A | 12/1987 | Boeke et al. | |
| 2003/0164240 | A1* | 9/2003 | Vinegar | E21B 34/08 166/372 |
| 2008/0314590 | A1 | 12/2008 | Patel | |
| 2013/0264072 | A1 | 10/2013 | Lopez et al. | |
| 2016/0281466 | A1 | 9/2016 | Richards | |

OTHER PUBLICATIONS

International Search Report and Written Opinion for International Application No. PCT/US2020/051353; International Filing Date Sep. 18, 2020; dated Dec. 10, 2020 (pp. 1-10).

* cited by examiner

*Primary Examiner* — Kristyn A Hall
*Assistant Examiner* — Dany E Akakpo
(74) *Attorney, Agent, or Firm* — Cantor Colburn LLP

(57) ABSTRACT

A retrievable in-flow control device (ICD) including a device body having a first end, a second end, an outer surface extending between the first end and the second end, and an internal flow path. A wireline connector is arranged at the first end. A latch mechanism is provided on one of the wireline connector and the device body. A flow control port extends through the outer surface to the internal flow path. An equalizer member including a first flow path for passing a first fluid and a second flow path for resisting flow of a second fluid. The retrievable ICD also includes a flow control device establishes a selected pressure drop of the first fluid through the retrievable ICD.

18 Claims, 5 Drawing Sheets

MODULAR SIDE POCKET ICD

BACKGROUND

In the drilling and completion industry, boreholes are created in a formation for the purpose of locating, identifying, and extracting formation fluids. In many cases, after forming the borehole a completion that guides formation fluids to a surface system is constructed. The completion may include one or more packers that separate the borehole into multiple production zones. The completion includes one or more in-flow control devices (ICDs) arranged in each of the multiple production zones. The ICD's provide a pathway from the borehole into the completion.

ICDs may include screens or other devices that control flow into the completion. Further, the ICD's may include valves that may be opened and/or closed in order to control fluid flow. Occasionally, an ICD may fail. For example, a screen may become clogged or torn, or a valve may cease to function. Repairing and/or replacing an ICD is a costly and time consuming procedure which may involve removing the completion. The art would be welcome an ICD that could be repaired and/or replaced without the need to remove the completion.

SUMMARY

Disclosed is a retrievable in-flow control device (ICD) including a device body having a first end, a second end, an outer surface extending between the first end and the second end, and an internal flow path. A wireline connector is arranged at the first end. A latch mechanism is provided on one of the wireline connector and the device body. A flow control port extends through the outer surface to the internal flow path. An equalizer member including a first flow path for passing a first fluid and a second flow path for resisting flow of a second fluid. The retrievable ICD also includes a flow control device that establishes a selected pressure drop of the first fluid through the retrievable ICD.

Also disclosed is a resource exploration and recovery system including a first system, and a second system including one or more tubulars extending from the first system into a formation. At least one of the one or more tubulars includes a central flow path and a side pocket radially offset from the central flow path. A retrievable in-flow control device (ICD) is arranged in the side pocket. The retrievable ICD includes a device body having a first end, a second end, an outer surface extending between the first end and the second end, and an internal flow path. A wireline connector is arranged at the first end. A latch mechanism is provided on one of the wireline connector and the device body. A flow control port extends through the outer surface to the internal flow path. An equalizer member including a first flow path for passing a first fluid and a second flow path for resisting flow of a second fluid. The retrievable ICD also includes a flow control device that establishes a selected pressure drop of the first fluid through the retrievable ICD.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
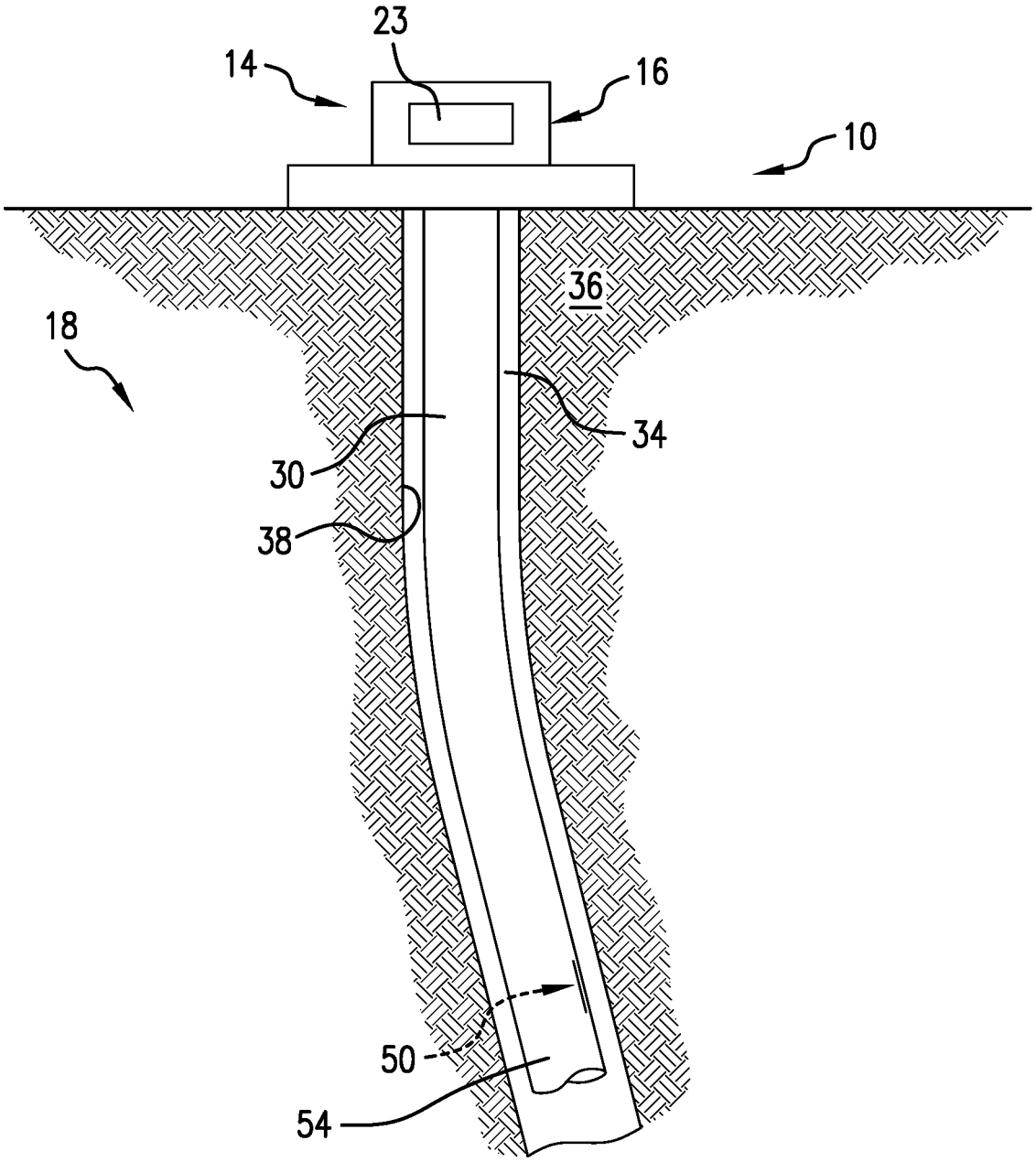
FIG. 1 depicts a resource exploration and recovery system including an inflow control device (ICD), in accordance with an exemplary embodiment.
Figure 2:
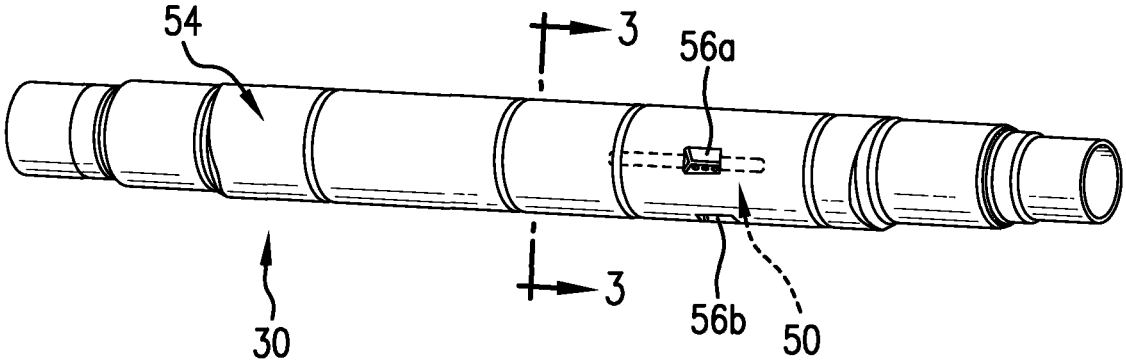
FIG. 2 depicts a side pocket tubular supporting an ICD, in accordance with an aspect of an exemplary embodiment.

A resource exploration and recovery system, in accordance with an exemplary embodiment, is indicated generally at 10, in FIGS. 1 and 2. Resource exploration and recovery system 10 should be understood to include well drilling operations, completions, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a downhole system.

First system 14 may include a control system 23 that may provide power to, monitor, communicate with, and/or activate one or more downhole operations as will be discussed herein. Surface system 16 may include additional systems such as pumps, fluid storage systems, cranes and the like (not shown). Second system 18 may include a tubular string 30 that extends into a wellbore 34 formed in formation 36. Tubular string 30 may take the form of a plurality of interconnected tubulars, coil tubing, or the like. Wellbore 34 includes an annular wall 38 which may be defined by a surface of formation 36. Further, it should be understood, that wellbore 34 may include a casing tubular (not shown).

Figure 3:
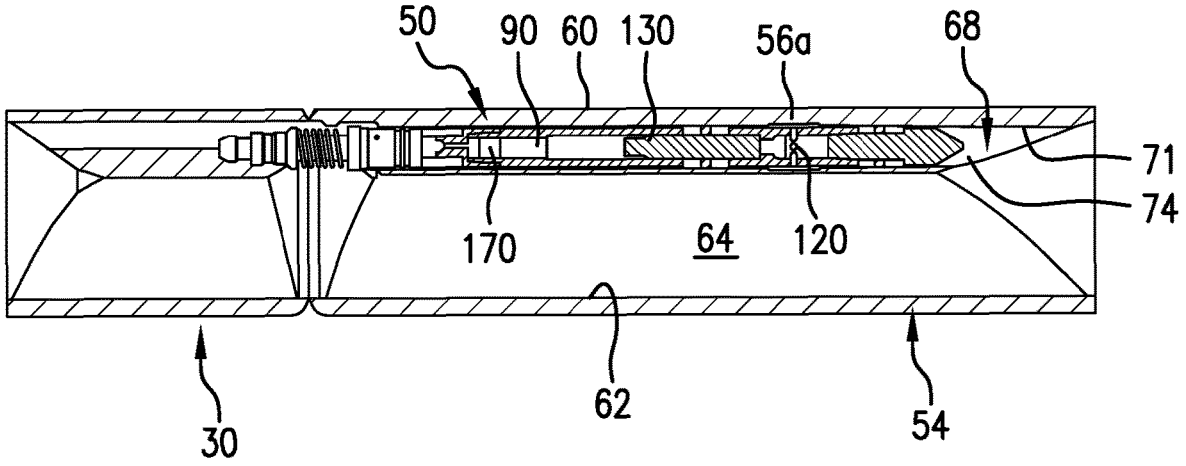
FIG. 3 depicts a partial cross-sectional view of the side pocket tubular of FIG. 2 taken along the lines 3-3, showing the ICD, in accordance with an aspect of an exemplary embodiment.

In an embodiment, tubular string 30 may support a retrievable inflow control device (ICD) 50. Referring to FIGS. 2-3, retrievable ICD 50 may be supported in an inflow tubular 54 that forms part of tubular string 30. The number and location of inflow tubulars may vary. Inflow tubular 54 includes a plurality of inflow ports, two of which are shown at 56*a* and 56*b*. Inflow tubular 54 includes an outer surface 60 and an inner surface 62 that defines a central flow path 64. A side pocket 68 is arranged between outer surface 60 and inner surface 62. Inflow port 56*a* extends through outer surface 60 and fluidically connect with side pocket 68. Side pocket 68 includes an inner surface portion 71 that defines a retrievable ICD receiving zone 74.

Figure 4:
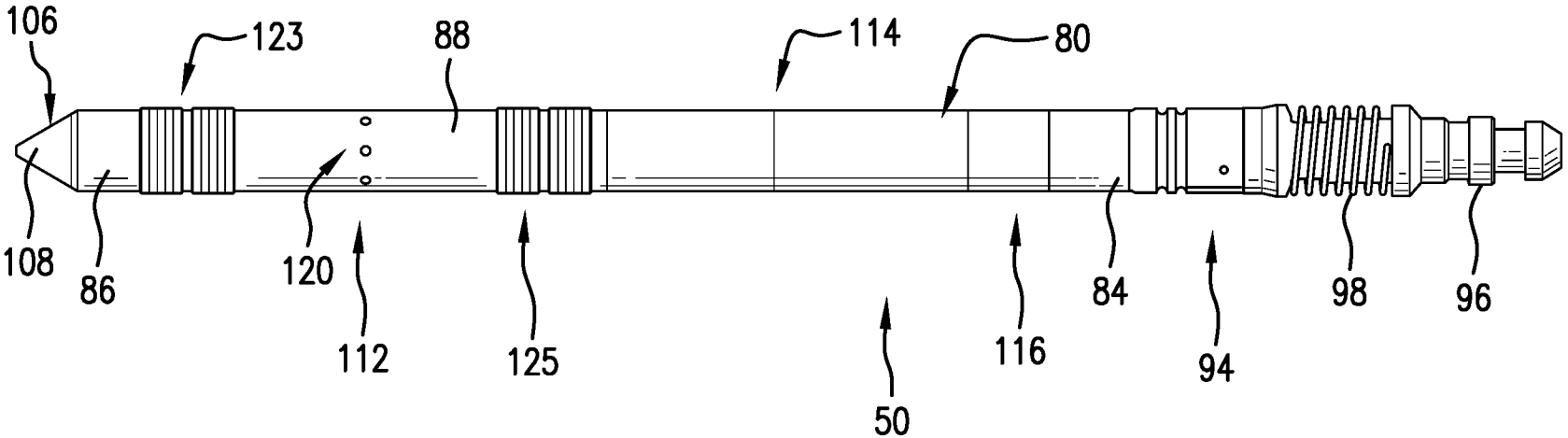
FIG. 4 depicts an ICD in accordance with an aspect of an exemplary embodiment.

Referring to FIG. 4, retrievable ICD 50 includes a device body 80 having a first end 84, an opposing second end 86, an outer surface 88, and an internal flow path 90 (FIG. 3). First end 84 may include a wireline connector 94, which may take the form of a fishing neck, having a latch mechanism 96 and a spring 98. Alternatively, latch mechanism 96 may be provided on device body 80. Wireline connector 94 may interface with and lock onto a wireline (not shown) so as to be installed into and/or retrieved from, side pocket 68. Second end 86 may include a centering element 106 that may serve to guide retrievable ICD 50 into side pocket 68.

Centering element 106 may include a conical surface 108. Centering element 106 may include a seal (not shown). Further, it should be understood that in lieu of providing centering element on ICD 50, centering may be provided by side pocket 68. In an embodiment, retrievable ICD 50 includes an inflow section 112, a flow equalizing section 114, and a flow control section 116.

Inflow section 112 includes a plurality of flow ports 120 that extend through outer surface 88 and fluidically connect with internal flow path 90. A first plurality of seals 123 may be arranged between first end 84 and plurality of flow ports 120 and a second plurality of seals 125 may be arranged between second end 86 and plurality of flow ports 120. First and second pluralities of seals 123 and 125 ensure that fluid passing through, for example, inflow port 56*a* enters into retrievable ICD 50 through plurality of flow ports 120.

Figure 5:
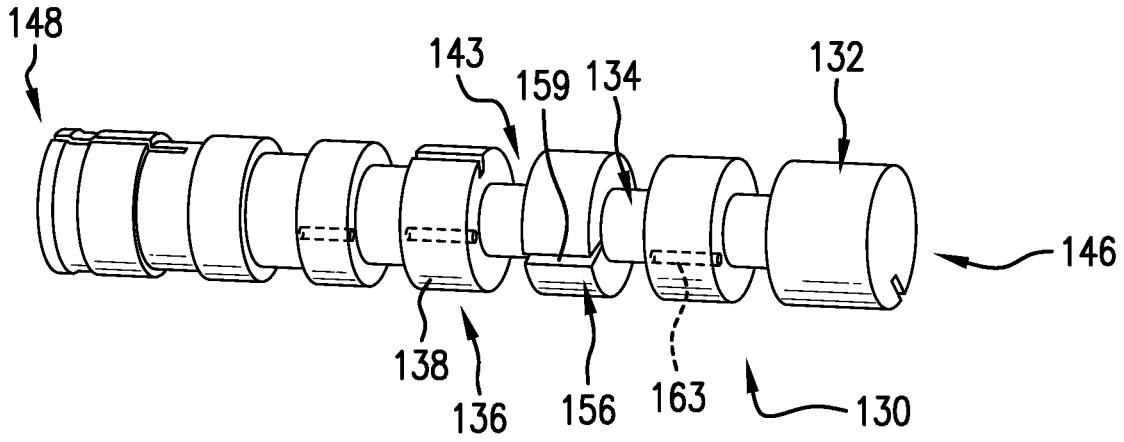
FIG. 5 depicts an equalizer member of the ICD of FIG. 4, in accordance with an aspect of an exemplary embodiment.
Figure 6:
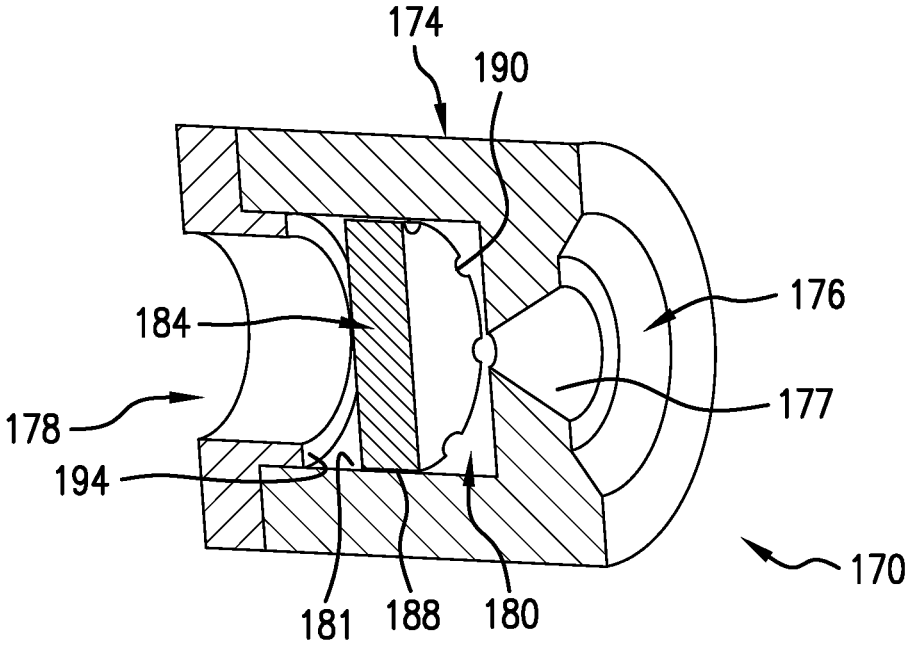
FIG. 6 depicts a flow control device of the ICD of FIG. 4, in accordance with an aspect of an exemplary embodiment.

An equalizer member 130 is arranged in flow equalizer section 114 downstream from plurality of flow ports 120. As shown in FIG. 5, equalizer member 130 include a body 132 including a central shaft 134 and a plurality of flow control discs 136. Flow control discs are spaced relative to one another and are concentric with central shaft 134. Each of the flow control discs 136 includes an outer annular surface 138 that is spaced from central shaft 134. At this point, it should be understood, that central shaft 134 includes a plurality of sections (not separately labeled) that include an outer diameter that may vary from one another. Further, each of the plurality of flow control discs 136 is spaced one from another to form flow control zones 143 having varying depths/volumes.

Equalizer member 130 includes an inlet end 146 and an outlet end 148. A first plurality of flow passages 156 are formed in outer annular edge 138 and designed to carry a first fluid, such as a petroleum fluid, from inlet end 146 to outlet end 148. First plurality of flow passages 156 take the form of slots 159 that are exposed at outer annular edge 138 and extend into each flow control disc 136. Slots 159 are circumferentially offset relative to one another so as to form a labyrinth flow path from inlet end 146 to outlet end 148. One or more of the slots 159 may extend from outer annular surface 138 into central shaft 134.

Equalizer member 130 also includes a second plurality of flow passages 163 that transport a second fluid, such as water, from inlet end 146 toward outlet end 148. Second plurality of flow passages 163 take the form of orifices (not separately labeled) that are spaced from outer annular surface 138. Second plurality of flow passages 163 are arranged radially inwardly of slots 159 and sized so as to inhibit the flow of the second fluid, e.g., water, in preference to the flow of the first fluid, e.g., petroleum from inlet end 146 toward outlet end 148. A flow control device 170 is arranged in flow control section 116 at outlet end 148. Flow control device 170 establishes a desired pressure control of the fluid passing from retrievable ICD 50 toward surface system 16.

In an embodiment, flow control device 170 includes a body 174 including an inlet 176 having, in accordance with an exemplary aspect, a tapered surface 177, and an outlet 178. A flow control chamber 180 is arranged between inlet 176 and outlet 178. Flow control chamber 180 includes an inner surface 181. Flow control device 170 includes a flow control element 184 that may be slidably mounted in flow control chamber 180. Flow control element 184 includes an outer annular edge 188 that may include a plurality of flow passages 190.

Flow control device 170 may also include a radially inwardly projecting sealing land 194 at outlet 178. With this arrangement, pressure from surface system 16 may be adjusted to establish a desired position of flow control element 185 in flow control chamber 180 from a full open position that allows maximum flow to pass from retrieval ICD 50 to a closed position, in which flow control element 184 rests upon radially inwardly projecting sealing land 194 cutting off flow through flow passages 190. It should be understood that flow control device 170 may take on a variety of forms including fixed orifices that is/are selected to achieve a selected pressure drop and adjustable orifices that may establish a range of pressure drops between inlet 176 and outlet 178 and through ICD 50.

At this point, it should be appreciated that the exemplary embodiments describe an inflow control device (ICD) that may be deployed into a tubular string following a completion. The ICD may be adjusted to allow production fluids to pass from a wellbore up to a surface system. Further, the ICD may be accessed from the surface system for maintenance purposes and/or removal and replacement. That is, a wireline may be dropped down to and connected with the ICD. The wireline may deliver a flushing fluid to clear out any blockages in the ICD. Alternatively, the wireline may connect with and remove the ICD to the surface. The wireline may then be run into the wellbore to deliver a new ICD into the side pocket.

Set forth below are some embodiments of the foregoing disclosure:

Embodiment 1

A retrievable in-flow control device (ICD) comprising: a device body having a first end, a second end, an outer surface extending between the first end and the second end, and an internal flow path; a wireline connector arranged at the first end; a latch mechanism provided on one of the wireline connector and the device body; a flow control port extending through the outer surface to the internal flow path; an equalizer member including a first flow path for passing a first fluid and a second flow path for resisting flow of a second fluid; and a flow control device establishing a selected pressure drop of the first fluid through the retrievable ICD.

Embodiment 2

The ICD according to any prior embodiment, wherein the equalizer member includes a central shaft supporting a plurality of discs including an outer annular surface, the plurality of discs being spaced one from another along the central shaft.

Embodiment 3

The ICD according to any prior embodiment, wherein the first flow path includes a first plurality of passages extending through each of the plurality of discs, the first plurality of passages being exposed to the outer annular surface.

Embodiment 4

The ICD according to any prior embodiment, wherein the each of the first plurality of passages is circumferentially offset relative to others of the first plurality of passages.

Embodiment 5

The ICD according to any prior embodiment, wherein one or more of the first plurality of passages extend into the central shaft.

Embodiment 6

The ICD according to any prior embodiment, wherein the second flow path comprises a second plurality of passages extending through select ones of the plurality of discs spaced from the outer annular surface.

Embodiment 7

The ICD according to any prior embodiment, wherein the select ones of the plurality of discs are less than all of the plurality of discs.

Embodiment 8

The ICD according to any prior embodiment, wherein the flow control device is arranged downstream of the equalizer member.

Embodiment 9

The ICD according to any prior embodiment, wherein the flow control device includes a body having an inlet, an outlet, and a flow control chamber arranged therebetween, the inlet having a first diameter and the outlet having a second diameter that is greater than the first diameter.

Embodiment 10

The ICD according to any prior embodiment, wherein the inlet includes a tapered orifice.

Embodiment 11

The ICD according to any prior embodiment, further comprising: a flow control element arranged between the inlet and the outlet, the flow control element including an outer annular edge that contacts an inner surface of the flow control chamber, the outer annular edge including one or more flow passages.

Embodiment 12

The ICD according to any prior embodiment, wherein the flow control element is axially shiftable within the flow control chamber.

Embodiment 13

The ICD according to any prior embodiment, wherein the second end included a radially inwardly projecting sealing land, the flow control element being shiftable into contact with the radially inwardly projecting sealing land to close off the one or more flow passages on the outer annular edge.

Embodiment 14

A resource exploration and recovery system comprising: a first system; a second system including one or more tubulars extending from the first system into a formation, at least one of the one or more tubulars including a central flow path and a side pocket radially offset from the central flow path; and a retrievable in-flow control device (ICD) arranged in the side pocket, the retrievable ICD comprising: a device body having a first end, a second end, an outer surface extending between the first end and the second end, and an internal flow path; a wireline connector arranged at the first end; a latch mechanism provided on one of the wireline connector and the device body; a flow control port extending through the outer surface to the internal flow path; an equalizer member including a first flow path for passing a first fluid and a second flow path for resisting flow of a second fluid; and a flow control device establishing a selected pressure drop of the first fluid through the retrievable ICD.

Embodiment 15

The resource exploration and recovery system according to any prior embodiment, wherein the equalizer member includes a central shaft supporting a plurality of discs including an outer annular surface, the plurality of discs being spaced one from another along the central shaft.

Embodiment 16

The resource exploration and recovery system according to any prior embodiment, wherein the first flow path includes a first plurality of passages extending through each of the plurality of discs, the first plurality of passages being exposed to the outer annular surface.

Embodiment 17

The resource exploration and recovery system according to any prior embodiment, wherein the second flow path comprises a second plurality of passages extending through select ones of the plurality of discs spaced from the outer annular surface.

Embodiment 18

The resource exploration and recovery system according to any prior embodiment, wherein the flow control device includes a body having an inlet, an outlet, and a flow control chamber arranged therebetween, the inlet having a first diameter and the outlet having a second diameter that is greater than the first diameter.

Embodiment 19

The resource exploration and recovery system according to any prior embodiment, further comprising: a flow control element arranged between the inlet and the outlet, the flow control element including an outer annular edge that contacts an inner surface of the flow control chamber, the outer annular edge including one or more flow passages.

Embodiment 20

The resource exploration and recovery system according to any prior embodiment, wherein the second end included a radially inwardly projecting sealing land, the flow control element being selectively shiftable within the flow control chamber into contact with the radially inwardly projecting sealing land to close off the one or more flow passages on the outer annular edge.

The terms "about" and "substantially" are intended to include the degree of error associated with measurement of the particular quantity based upon the equipment available at the time of filing the application. For example, "about" and/or "substantially" can include a range of 8% or 5%, or 2% of a given value.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A retrievable in-flow control device (ICD) comprising:
- a device body having a first end, a second end, an outer surface extending between the first end and the second end, and an internal flow path;
- a wireline connector arranged at the first end;
- a latch mechanism provided on one of the wireline connector and the device body;
- a flow control port extending through the outer surface to the internal flow path;
- an equalizer member including a first flow path for passing a first fluid and a second flow path for resisting flow of a second fluid, wherein the equalizer member includes a central shaft supporting a plurality of discs including an outer annular surface, the plurality of discs being spaced one from another along the central shaft; and
- a flow control device establishing a selected pressure drop of the first fluid through the retrievable ICD.

2. The ICD according to claim 1, wherein the first flow path includes a first plurality of passages extending through each of the plurality of discs, the first plurality of passages being exposed to the outer annular surface.

3. The ICD according to claim 2, wherein the each of the first plurality of passages is circumferentially offset relative to others of the first plurality of passages.

4. The ICD according to claim 2, wherein one or more of the first plurality of passages extend into the central shaft.

5. The ICD according to claim 2, wherein the second flow path comprises a second plurality of passages extending through select ones of the plurality of discs spaced from the outer annular surface.

6. The ICD according to claim 5, wherein the select ones of the plurality of discs are less than all of the plurality of discs.

7. The ICD according to claim 1, wherein the flow control device is arranged downstream of the equalizer member.

8. The ICD according to claim 7, wherein the flow control device includes a body having an inlet, an outlet, and a flow control chamber arranged therebetween, the inlet having a first diameter and the outlet having a second diameter that is greater than the first diameter.

9. The ICD according to claim 8, wherein the inlet includes a tapered orifice.

10. The ICD according to claim 8, further comprising: a flow control element arranged between the inlet and the outlet, the flow control element including an outer annular edge that contacts an inner surface of the flow control chamber, the outer annular edge including one or more flow passages.

11. The ICD according to claim 10, wherein the flow control element is axially shiftable within the flow control chamber.

12. The ICD according to claim 11, wherein the second end included a radially inwardly projecting sealing land, the flow control element being shiftable into contact with the radially inwardly projecting sealing land to close off the one or more flow passages on the outer annular edge.

13. A resource exploration and recovery system comprising:
- a first system;
- a second system including one or more tubulars extending from the first system into a formation, at least one of the one or more tubulars including a central flow path and a side pocket radially offset from the central flow path; and
- a retrievable in-flow control device (ICD) arranged in the side pocket, the retrievable ICD comprising:
  - a device body having a first end, a second end, an outer surface extending between the first end and the second end, and an internal flow path;
  - a wireline connector arranged at the first end;
  - a latch mechanism provided on one of the wireline connector and the device body;
  - a flow control port extending through the outer surface to the internal flow path;
  - an equalizer member including a first flow path for passing a first fluid and a second flow path for resisting flow of a second fluid, wherein the equalizer member includes a central shaft supporting a plurality of discs including an outer annular surface, the plurality of discs being spaced one from another along the central shaft; and
  - a flow control device establishing a selected pressure drop of the first fluid through the retrievable ICD.

14. The resource exploration and recovery system according to claim 13, wherein the first flow path includes a first plurality of passages extending through each of the plurality of discs, the first plurality of passages being exposed to the outer annular surface.

15. The resource exploration and recovery system according to claim 14, wherein the second flow path comprises a second plurality of passages extending through select ones of the plurality of discs, the second plurality of passages being spaced from the outer annular surface.

16. The resource exploration and recovery system according to claim 13, wherein the flow control device includes a body having an inlet, an outlet, and a flow control chamber arranged therebetween, the inlet having a first diameter and the outlet having a second diameter that is greater than the first diameter.

17. The resource exploration and recovery system according to claim 16, further comprising: a flow control element arranged between the inlet and the outlet, the flow control element including an outer annular edge that contacts an inner surface of the flow control chamber, the outer annular edge including one or more flow passages.

18. The resource exploration and recovery system according to claim 17, wherein the second end included a radially inwardly projecting sealing land, the flow control element being selectively shiftable within the flow control chamber into contact with the radially inwardly projecting sealing land to close off the one or more flow passages on the outer annular edge.

* * * * *